US006581914B2

(12) United States Patent
Saura Sotillos et al.

(10) Patent No.: US 6,581,914 B2
(45) Date of Patent: Jun. 24, 2003

(54) MODULAR FENCE

(76) Inventors: Juan Jose Saura Sotillos, Ctra. Villaverde-Vallecas, 295, 28031 Madrid (ES); Jorge Antonio Saura Sotillos, Ctra. Villaverde-Vallecas, 295, 28031 Madrid (ES)

( * ) Notice: Subject to any disclaimer, the term of this patent is extended or adjusted under 35 U.S.C. 154(b) by 32 days.

(21) Appl. No.: 09/849,292

(22) Filed: May 4, 2001

(65) Prior Publication Data

US 2002/0027225 A1 Mar. 7, 2002

(30) Foreign Application Priority Data

May 5, 2000 (ES) ..... 200001137
Feb. 26, 2001 (ES) ..... 200100442

(51) Int. Cl.[7] ..... E04H 17/10

(52) U.S. Cl. ..... 256/73; 256/35; 256/48
(58) Field of Search ..... 256/73, 32, 33, 256/35, 34, 23, 47, 48, 1, 65.01

(56) References Cited

U.S. PATENT DOCUMENTS

| | | | | | |
|---|---|---|---|---|---|
| 1,127,493 | A | * | 2/1915 | Nagy | 256/35 |
| 2,753,156 | A | * | 7/1956 | Rieger | 256/35 |
| 4,208,038 | A | * | 6/1980 | Reid | 256/65 |
| 4,290,602 | A | * | 9/1981 | Kennedy | 256/32 |
| 4,553,740 | A | * | 11/1985 | Bailey | 256/33 |
| 5,240,230 | A | * | 8/1993 | Dougherty | 256/65 |
| 5,275,382 | A | * | 1/1994 | Charbaut et al. | 256/48 |
| 5,542,649 | A | * | 8/1996 | Allegaert et al. | 256/32 |

* cited by examiner

*Primary Examiner*—Lynne H. Browne
*Assistant Examiner*—Kenn Thompson
(74) *Attorney, Agent, or Firm*—Ostrolenk, Faber, Gerb & Soffen, LLP

(57) ABSTRACT

Modular fence, consisting of wire-mesh panels (1) and tubular fixing posts (3), which are anchored at the bottom into the ground or into a supporting base. The panels (1) have horizontally shaped features (6) of a depth approximately equal to the diameter or width of the posts (6). These posts are fitted snugly between the rods of the shaped features and of the non-shaped regions, between two consecutive vertical rods.

18 Claims, 8 Drawing Sheets

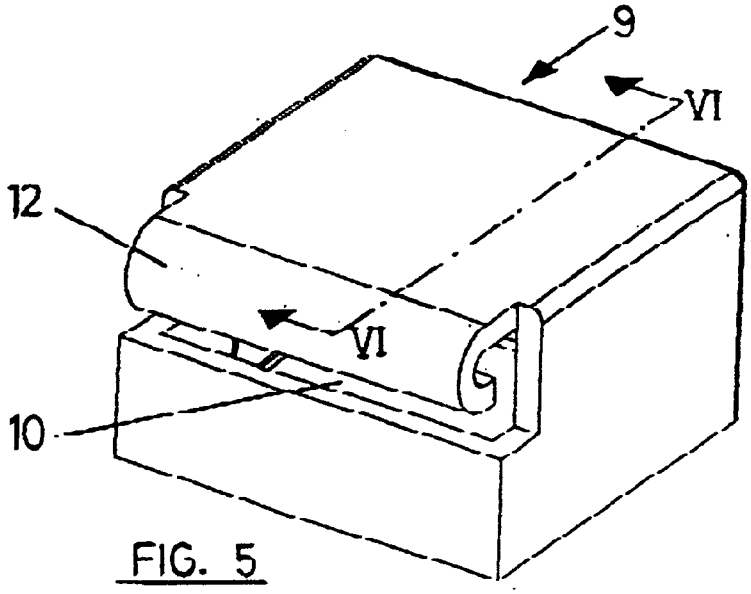
FIG. 5
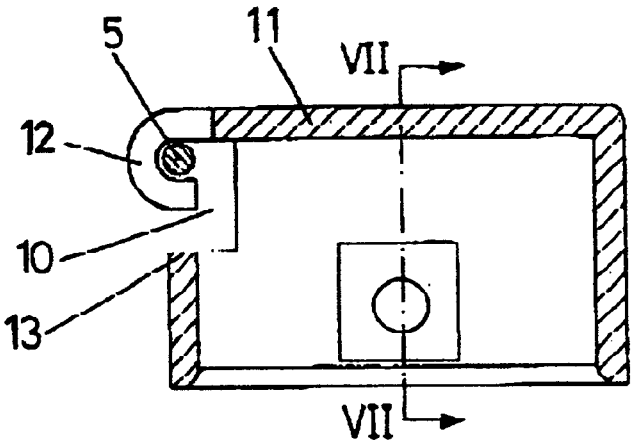
FIG. 6
FIG. 7
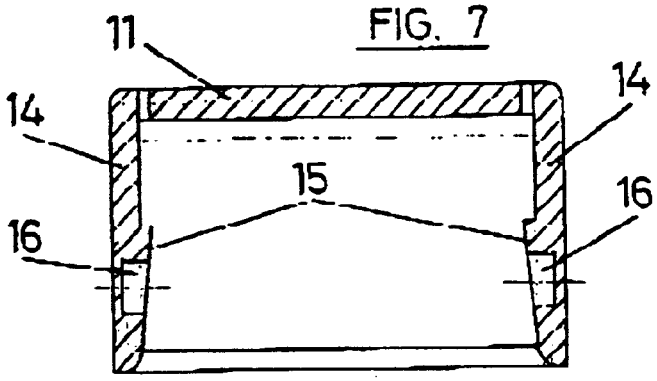

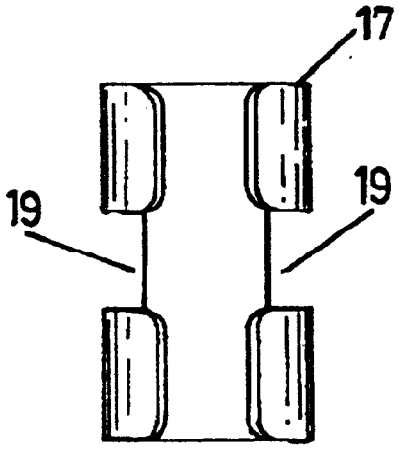
FIG. 8
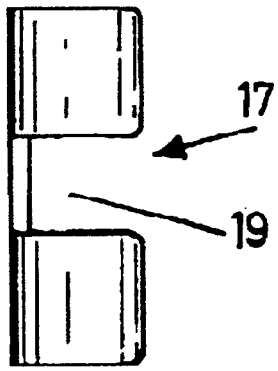
FIG. 9
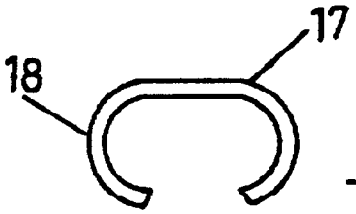
FIG. 10
FIG. 11
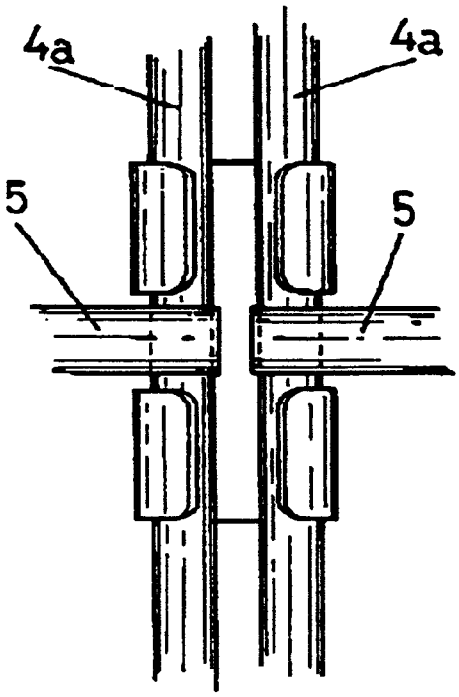
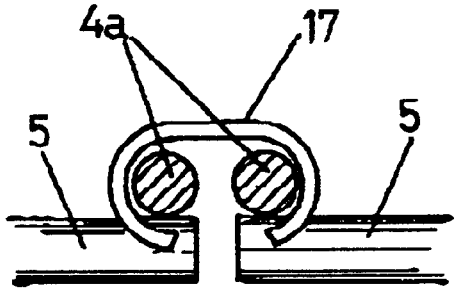
FIG. 12

FIG. 13
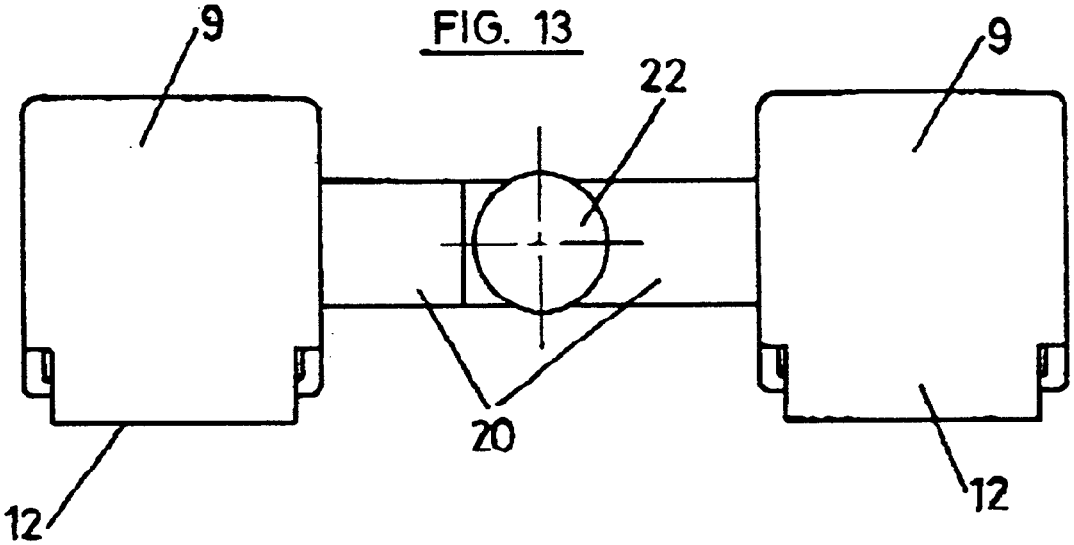
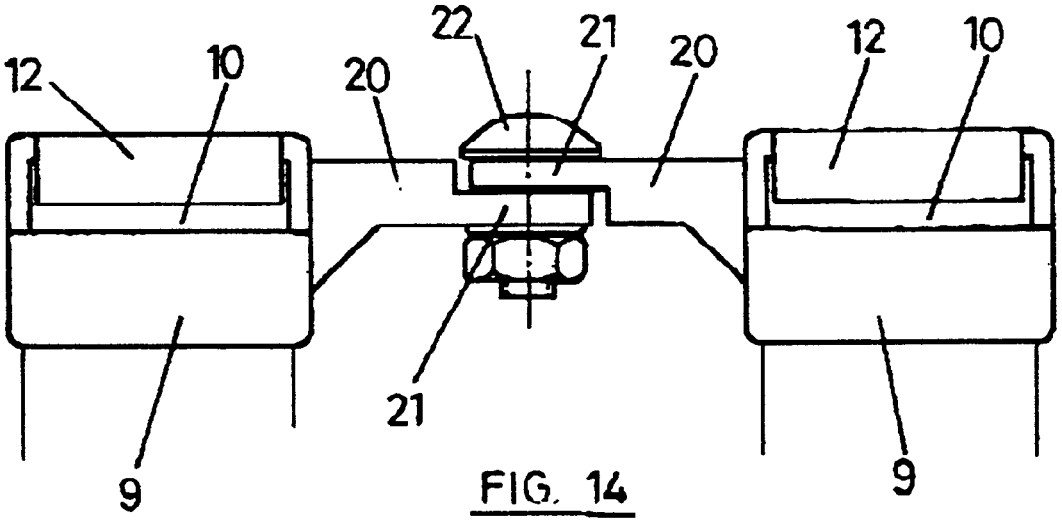
FIG. 14

MODULAR FENCE

BACKGROUND OF THE INVENTION

The present invention relates to a modular fence, of the type comprised of mesh panels, usually based on electrically welded metal wires, and of tubular support posts which are fixed at the bottom into the ground or into supporting bases.

PRIOR ART

Fences of the type mentioned are widely used in forming enclosures, which may be fixed as well as removable.

Panels of which these fences are comprised generally consist of two series of rods which intersect perpendicularly and the intersecting rods are joined together by electrical welds at the points of intersection. The mesh can be mounted in a rectangular frame formed from metal sectional bars, for example. Two of the parallel sides of the frame have means enabling joining the sides together and to the support posts. For example, see EP 0808969. These types of panels are expensive, because they include the peripheral frame.

A metal fence known from Spanish Utility Model 9301333 is formed of panels which are mounted on vertical stanchions based on L-shaped sectional bars. The long leg of these sectional bars has flanges on its inner surface for anchoring the meshes. Moreover, this leg has orifices pierced vertically into it. When the fence is set up, the adjacent vertical stanchions of consecutive panels are joined together by the long leg of the L, with the orifices facing each other in order that fixing screws may pass through. This system requires prior operations for fixing of the mesh to the vertical sectional bars and, subsequently, requires connection between sectional bars by means of screws. The cost of the fence is high, due to both the forming of the panels and the operations for joining consecutive panels together.

Mesh-based panels are also known, which are made up as set out above, and in which the mesh has horizontally extending shaped depressions which make it possible to insert the vertical posts between the ends of the horizontal wires, outside the extreme vertical wires, with the horizontal wires being welded to the posts. This construction requires the mesh to be joined to the vertical posts by welding, which also increases the costs of manufacture and limits the composition of the fence, so that the mesh and posts are made up as a single piece.

SUMMARY OF THE INVENTION

The object of the present invention is to eliminate the problems mentioned, in a fence of the type set out at the beginning, in which the panels and support posts constitute independent elements and in which the panels are formed only by a mesh, which comprises two perpendicular series of wires, joined together by welding at their points of intersection.

A further object of the invention is to provide a fence in which the connecting or fixing of the mesh-based panels to the vertical support posts can be carried out rapidly and simply, without complicated joining operations.

The fence of the invention, as noted above, is comprised of mesh panels and tubular fixing posts.

In accordance with the invention, the mesh panels have horizontally extending shaped depressions, depressed to a depth, approximately equal to the width of the fixing posts. These posts are inserted snugly between the horizontal rods of the depressions and of the non-shaped, non-depressed horizontally extending regions, and in a direction perpendicular to the horizontal rods, and between two consecutive vertical rods.

The two consecutive vertical rods between which a fixing post is inserted are separated from each other by a distance equal to the width of the posts.

With this construction, the vertical tubular posts are inserted snugly between the horizontal rods of the shaped depressions and the non-shaped regions and between the above-mentioned two consecutive vertical rods.

The mesh panels may be bounded at their vertical edges by the two extreme vertical rods, and the horizontal rods will terminate at these extreme rods. On the other hand, all the vertical rods can be shaped apart an equal distance from each other, corresponding to the width of the parts, such that in forming the fence, each panel can be mounted on one, two or more posts, taking up intermediate or extreme positions on the panel.

The mesh panels include at least two horizontally shaped features, each of them close to one of the horizontal edges of the panel.

Also preferably, the horizontally shaped features will be of a height greater than the separation between two consecutive horizontal rods.

In forming a fence, the meshes belonging to consecutive panels can be connected together by means of clips comprised of channeled pieces with a C-shaped profile, partially closed, dimensioned to embrace the two adjacent extreme vertical rods of two consecutive panels. The walls of these C-shaped pieces have two opposed intermediate transverse cut-outs, of a width sufficient for being coupled onto two aligned horizontal rods, one on each side, and belonging to the two consecutive panels.

As is traditional with this type of fence, the vertical tubular columns are closed off by a cap-shaped upper cover. In accordance with the invention, this cap has an aperture in its side wall, cutting across the cap, parallel and adjacent the bottom of the cap. Coincident with the cap a flange projects all along the length of the cap and in extension of the bottom of the cap. The flange forms a channel that is turned towards the aperture and is separated from the lower edge of the channel by a distance greater than the diameter of the rods which make up the meshes of the panels.

This channel can be coupled around the upper horizontal rod of the panel, with freedom to rotate on that rod. This serves as an anchoring or fastening element between the mesh and the post.

The walls of the cover which are perpendicular to the above-mentioned aperture have curving projections on their inner surface which projections can be inserted into opposable orifices in the walls of the tubular posts, when the cover is coupled onto the post. The projections can define locking devices, which may or may not be releasable.

The mesh panels can be finished off, both at their top and their bottom, by an arched longitudinal stretch, which is turned towards the same side as the horizontally extending shaped depressions of the panel and is of slightly greater width than the depth of the depressions. This accommodates the corresponding end of the metal posts and, in the case of the upper end, also accommodates the anchoring cover of the post. The arched stretch is bounded by horizontal rods. The above-mentioned cover is anchored to one of the rods. This arched stretch is preferably of approximately semicircular profile, substantially equal in diameter to the width of the cover which closes off the anchor posts.

BRIEF DESCRIPTION OF THE FIGURES

The characteristics set forth, as well as others which are specific to the invention, are described below with reference to the attached drawings, in which a non-limiting embodiment example is shown.

BRIEF DESCRIPTION OF THE DRAWINGS

Figure 1:
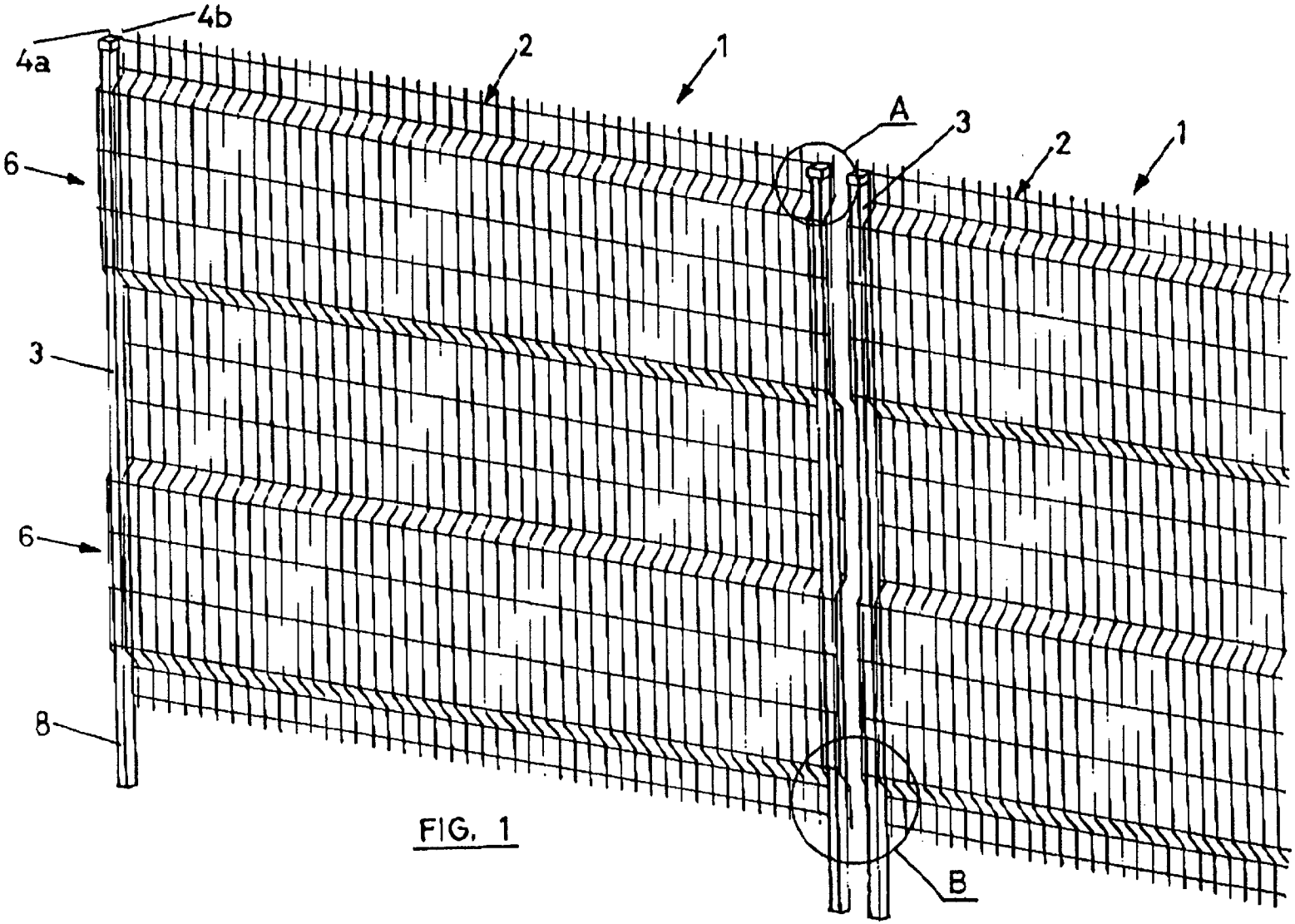

FIG. 1 shows, in perspective, a portion of a fence according to the invention.

Figure 2:
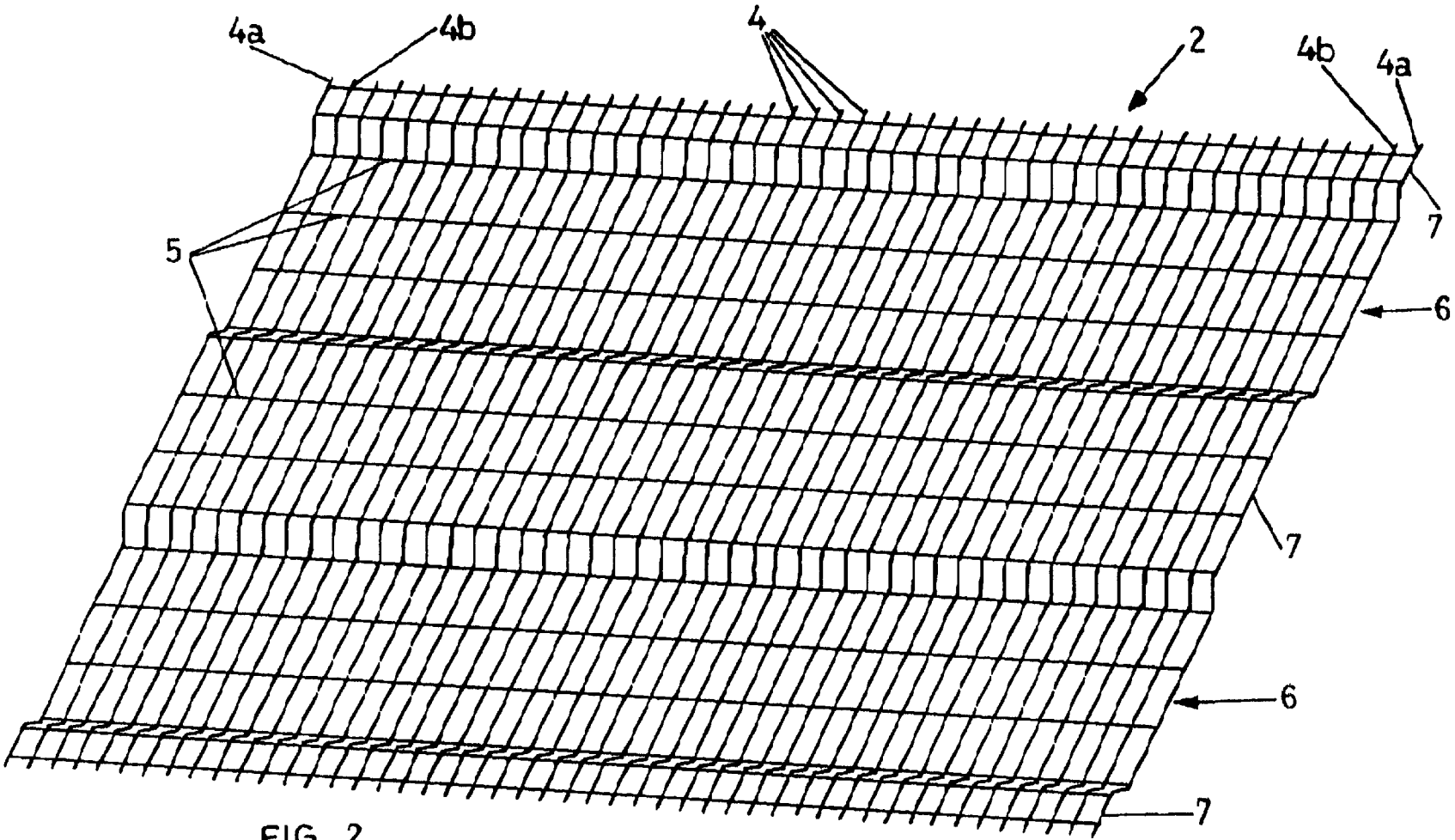

FIG. 2 is a perspective view of a mesh panel which forms part of the fence of FIG. 1.

Figure 3:
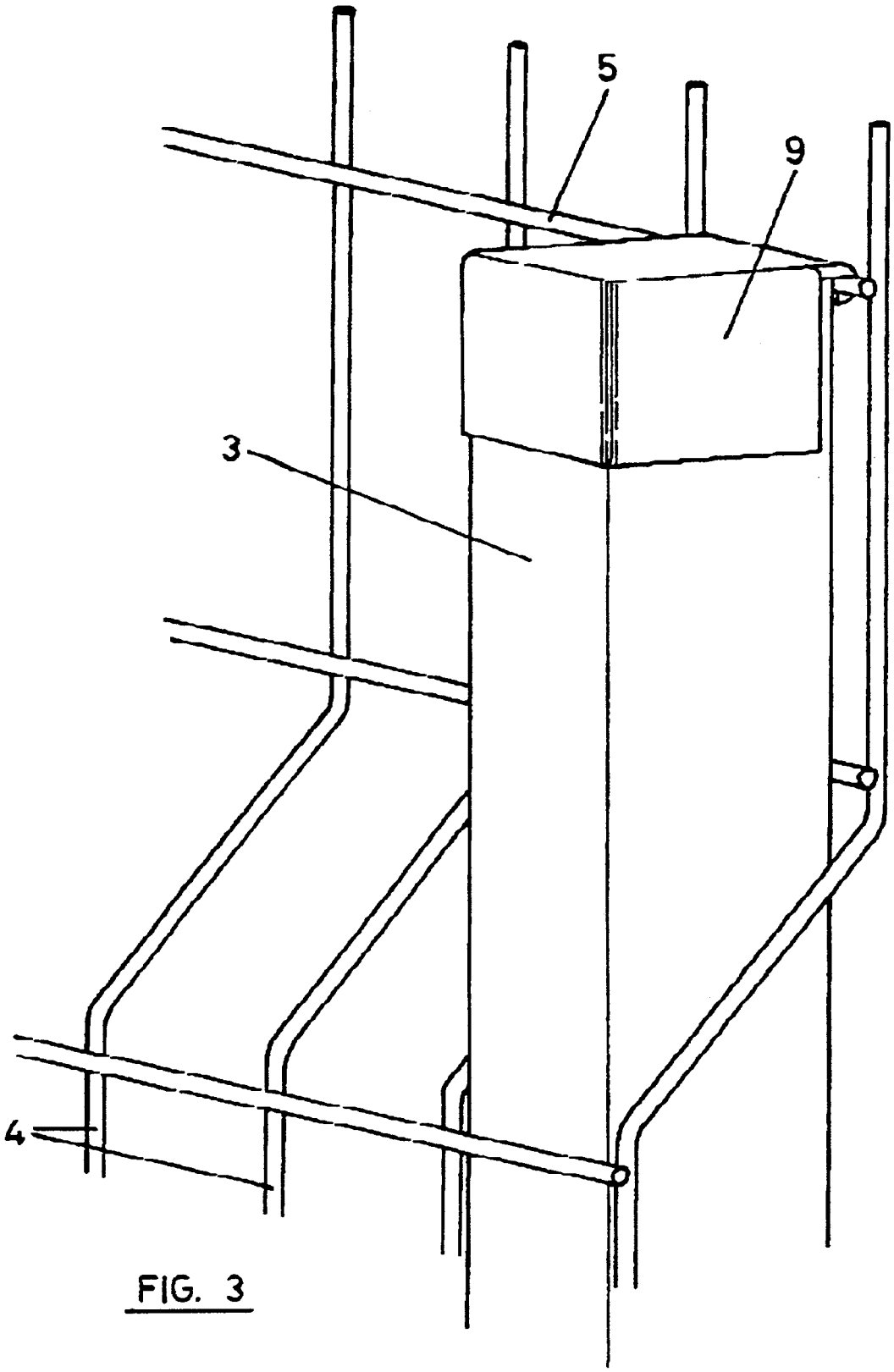

FIG. 3 shows detail A of FIG. 1, on a larger scale.

Figure 4:
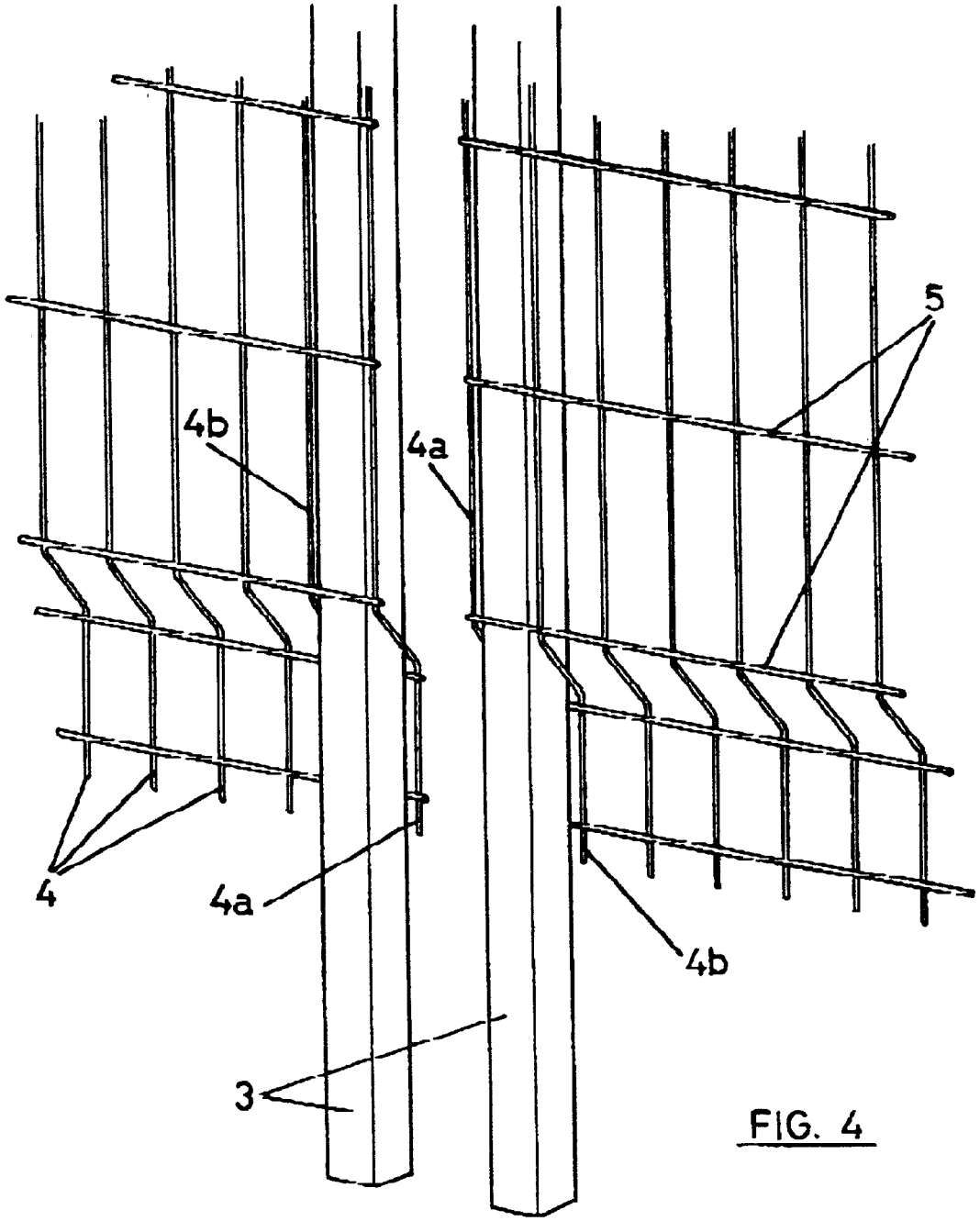

FIG. 4 shows detail B of FIG. 1, on a larger scale.

FIG. 5 is a perspective view of a cover which closes off the upper end of the tubular posts.

FIG. 6 is a cross section of the cover, along the sectional line VI—VI of FIG. 5.

FIG. 7 is a cross section of the cover, along the sectional line VII—VII of FIG. 6.

FIGS. 8, 9 and 10 are a front view, a side view, and a profile view of a clip for connecting consecutive panels.

FIGS. 11 and 12 are views similar to FIGS. 8 and 10, respectively, showing the clip mounted on the adjacent rods of consecutive meshes.

FIGS. 13 and 14 are a front elevation and a top view, respectively, of two covers or caps equipped with connecting means.

Figure 15:
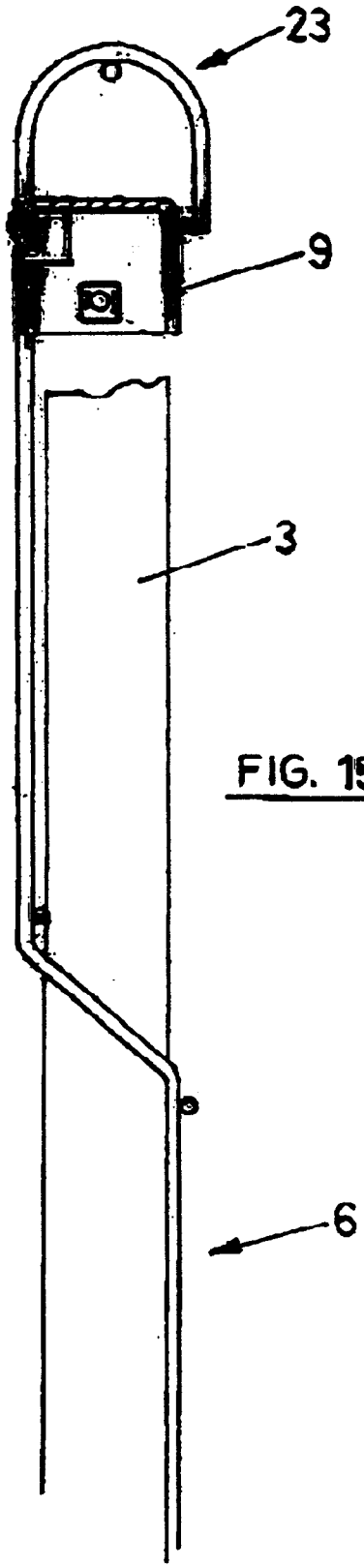

FIG. 15 shows a variant of the fence represented in the previous Figures, in which it appears finished off at the top in a curved shape.

DESCRIPTION OF THE PREFERRED EMBODIMENT

FIG. 1 shows a portion of a fence which is comprised of consecutive modules 1, and each module is comprised of a wire-mesh panel 2 and of two vertical, tubular end posts 3.

As can be appreciated from FIG. 2, each wire-mesh panel 2 is of rectangular contour and is made up from two series of wires, referenced with the numbers 4 and 5, which intersect mutually perpendicularly and are joined together by welds at their points of intersection. The wires 5 run horizontally and the wires 4 run in the vertical direction. The mesh panel 2 thus formed is shaped with horizontally extending features 6, particularly depressions with two shown in the example in FIG. 2. Each depression is situated close to one of the horizontal edges of the panel 2. The depth of the shaped depression 6, with respect to the non-depressed regions 7, is approximately equal to the width of the vertical posts 3, if they are of square cross section or to their diameter, if they are of circular cross section.

The tubular posts 3 can take up intermediate or extreme positions along the panel 2. In the latter case, the meshes 2 are bounded at their vertical edges by end rods 4*a*, and the horizontal rods 5 coincidentally end at rods 4*a*. The extreme vertical rods 4*a* and the vertical rods 4*b* situated immediately beside and inwardly from the rods 4*a* are separated from each other by a distance approximately equal to or slightly greater than the diameter or width of the posts 3.

In forming the fence represented in FIG. 1, the vertical tubular posts 3 are fitted snugly between the horizontal rods of the shaped depressions 6 and of non-depressed regions 7, between consecutive vertical rods, preferably between the end pairs of rods 4*a* and 4*b*.

The posts 3 project from below the lower edge of the meshes 2 over a section 8 of the posts intended to be inserted into the ground or into a support base.

In the example, the tubular vertical posts 3 are of square section. FIGS. 3 and 4 show how these posts are inserted between the horizontal rods 5 of the shaped depressions 6 and the non-depressed regions 7 and between the consecutive end rods 4*a* and 4*b*. The posts 3 could alternatively be of circular section.

As can be better seen in FIG. 3, the tubular posts 3 are each closed at the top by a cover 9, formed, for example, from plastic.

The cover 9, as can be seen better in FIGS. 5 to 7, is formed by a cap having an internal periphery which coincides with the outer periphery of the respective column 3. The cap or cover 9 has an aperture 10 that cuts through one of its walls adjacent the closed bottom 11 of the cover. Coincident with this aperture 10, the bottom 11 of the cover is extended into a lateral flange 12 which is curved or folded inward for the purpose of forming a channel, and that curved flange is open toward the inside of the cap and the flange is separated from the lower edge 13 of the aperture 10 by a distance which is greater than the diameter of the rods which form the mesh of the panels.

This construction enables the cover or cap 9 to be fitted by the channel or shaped feature 12 on the upper horizontal rod 5 of the mesh, as shown in FIGS. 3 and 7. The cover 9 is able to swing around this upper rod 5 so that the cover serves as a linking or connecting element between the columns 3 and the meshes 2, when the cover 9 is coupled onto the upper end of the columns, as seen in FIG. 3.

If the posts are of circular section, the covers have the same circular contour. The panel uses the same aperture, which is cut, close to the bottom, to extend the bottom of the cover into a flange with a straight free end from which the cover is curved or folded in order to form the channel intended to be held on the rod of the panels. This is the same way as described with reference to FIGS. 5 to 7.

Those walls 14 of the cover or cap 9, which are perpendicular to the wall, in which the aperture 10 is formed, may have two locking projections on their inner surface, which comprise ramps 15, which both project in an ascending direction, which are bounded upward by flat sections. These ramps are capable of being inserted into opposable orifices which are defined in two of the opposed walls of the columns 3. On initiation of the coupling of the covers 9 onto the upper end of the columns, the ramps 15 cause a certain elastic deformation of the walls of the cap until the apertures in the walls of the columns 3 are reached. At that moment, the ramps become inserted into the apertures in order to serve as catches for preventing the ramps from being extracted, thereby preventing the fence being taken down.

Instead of the ramps 15, the locking projections may comprise small, rounded protuberances, of lesser diameter than the diameters of the apertures in the walls of the columns 3, to thus serve as releasable locking elements. This allows the covers 9 to be separated from the columns 3 and thereby allows the fence to be taken down. The same effect would be achieved if each locking projection were bounded by two ramps with opposite inclinations.

Coincident with the ramps 15, the walls 14 may have orifices 16, which may be partially closed at the outside, for example in order for rods to be inserted for connecting between posts for consecutive panels. This connection can also be formed by bolts inserted through opposed orifices of adjacent columns of consecutive panels 2.

The connection between consecutive panels can also be formed by clips as shown in FIGS. 8 to 10. This clip is comprised of a channel piece with a C-shaped profile 17, partially closed, and the walls 18 of the C's have two intermediate opposed cut-outs 19.

The C-shaped profile 17 is dimensioned to accommodate two extreme vertical rods belonging to consecutive panels. The clips are fitted in such a way that they embrace the adjacent extreme vertical rods 4*a* of the two consecutive panels, coincident with aligned horizontal rods 5 of the two panels, which will be situated in coincidence with the cut-outs 19 of the clip.

The connection between consecutive panels can also be formed by covers 9, shown in FIGS. 14 and 15. These covers each have a side arm 20 extending toward the other cover and each cover terminates in a section 21 of lesser thickness, as an upper connector on some covers and a lower connector on the others, and with a through orifice, such that the sections 21 of the adjacent covers of two consecutive panels can be superimposed as shown so that the orifices of the two sections 21 are brought into alignment for a screw 22 to be inserted, to serve as an axis of articulation. This enables situating the covers 9 with their arms 20 in alignment for connecting co-planar consecutive panels, or forming an angle for connecting consecutive panels at an angle and forming a corner.

With these constructions, a fence is provided which can be erected easily. It has vertical columns 3 which only need be inserted between the horizontal rods 5 of the depressed sections 6 and the non-depressed regions 7, and between the two extreme rods 4*a* and 4*b* at each end of the panel. Then each cover 9 is fitted onto the upper horizontal rods 5 and coupled on and fitted over the end of the column 3. Connection between consecutive panels which make up the fence can be achieved by clips 17, in the way described with reference to FIGS. 8 to 12, and also by way of rods or wires inserted through the orifices 15 of the covers 9.

The meshes 2 which form part of the panels may exhibit shaped depressions 6 in a number and configuration other than as represented in the example described. Likewise, the anchor posts 3 may be other than square in cross section, and may be without the covers 9.

The vertical rods 4 may project above and below the extreme top and bottom horizontal rods, or with respect to only one of these extreme horizontal rods. In this latter case the mesh 1 may make use of the projecting stretches of the vertical rods turned upward to serve as elements for dissuading access, or turned downwards, in which case the mesh will have a straight upper edge, free from pointed elements.

As shown, the horizontally extending depressions 6 of the meshes may be of trapezoidal profile in cross-section. This shape, combined with the tubular posts 3 and meshes 1 constituting independent elements, makes it possible to stack meshes one on top of the other for storage and transport to form compact packages, consequently reducing their volume. This enables the fence to be transported easily completely dismantled. Fence erection at the installation site is easily performed using simple operations, as has been explained, without the requirement for tools or welding on site.

As shown in FIG. 15, the upper part of the panels may be finished off with an arched longitudinal stretch 23 which is turned in the same direction as the depression of the depressed sections 6.

The stretch 23 features a width or diameter which is slightly greater than the depth of the depressed sections 6 and substantially equal to the width of the cover 9 which is fixed to the upper end of the posts 3.

The horizontally extending shaped depressions 6 could be of a different profile than that shown in the drawings, for example of a sinusoidal profile.

What is claimed is:

1. A modular fence comprising a plurality of wire mesh panels and a plurality of support posts attached to the panels;

the posts being installable on a supporting base, the support posts having a width or diameter;

each panel comprising a plurality of vertical rods spaced apart from one another and a plurality of horizontal rods spaced apart from one another, the horizontal rods intersecting the vertical rods, at least two of the vertical rods on each of the panels being separated by a distance approximately equal to the diameter or width of a respective one of the support posts which is positioned between the at least two vertical rods;

the panel having a profile such that there is a non-depressed section of the panel and at least one horizontally extending inward depression of the panel; the at least two vertical rods and the support post between them extending in the vertical direction transverse to the horizontally extending depression of the panel and the vertical rods and the support post being of such length that the support post extends between the vertical rods and over a vertical distance to extend past the non-depressed section and the depression of the panel;

a cap shaped cover over at least one of the support posts and the cover being movable with respect to the at least one post so that in one position of the cover, the cover on the post engages one of the horizontal rods of the panel for coupling the panel to the post;

wherein the cover is attachable to the one horizontal rod to rotate with respect to the one horizontal rod onto and off the post.

2. The fence of claim 1, wherein there are a plurality of the horizontally extending shaped depressions of each of the panels.

3. The fence of claim 2, wherein there are a plurality of the panels each having the at least two vertical support rods and a respective one of the support posts extending between the at least two vertical rods.

4. The fence of claim 3, wherein each panel has a lateral end and the at least two vertical rods are at one of the lateral ends of the panel.

5. The fence of claim 4, wherein there is a respective pair of the vertical rods at each lateral end of each panel and a respective one of the support posts between the two vertical rods at each end of each panel.

6. The fence of claim 3, wherein at least two of the panels have lateral ends and a lateral end of each of the two panels is arranged adjacent the lateral end of the other adjacent panel, the lateral ends of the panels having an extreme vertical rod at the lateral end thereof adjacent to the lateral end of the other panel;

clips connectable onto the extreme vertical rods of the adjacent lateral ends of two adjacent panels for holding the adjacent panels together.

7. The fence of claim 6, wherein the clips comprise channel shaped pieces with a C-shaped profile that is partially closed and of a dimension to receive the extreme vertical rods lengthwise within the C-shaped profile.

8. The fence of claim 7, wherein there are opposed intermediate transverse cutouts along the length of the C-shaped profile, the cutouts being of a width sufficient for being coupled onto aligned ones of the horizontal rods of the adjacent panels.

9. The fence of claim 3, further comprising a respective cover on each of the support posts for anchoring the support post to its respective panel; each of the at least two panels has an upper edge and each of the panels is finished off at its upper edge in an arched longitudinal stretch which is depressed towards the same side as the horizontally extending shaped depressions of the panel and which are of slightly greater width than the depth of the depressions for accommodating the upper end of the support posts and the respective covers for anchoring the posts; respective ones of the horizontal rods defining the arched stretch and the covers being anchored to one of the horizontal rods.

10. The fence of claim 9, wherein the arched stretch is of approximately semicircular profile and substantially equal in diameter to the width of the cover for closing off the upper end of the fixing post.

11. The fence of claim 1, wherein the cover includes a lateral flange bent toward the cover and which is wrapped around the one horizontal rod so that the cover may rotate around the one horizontal rod.

12. The fence of claim 11, wherein the cover includes a cap having peripheral walls and a closed bottom which fits over the post; an aperture into one of the walls of the cover extending parallel to and being located adjacent to the bottom of the cover; the lateral flange projecting outward from the bottom of the cover, the flange being turned inward to define a channel for receiving the one horizontal rod therein and the flange being shaped as to define an open channel between the flange and the respective wall of the cover, leaving an opening greater than the diameter of the one horizontal rod for enabling entry of the one horizontal rod through the channel for the one horizontal rod to then be received in the flange.

13. The fence of claim 12, wherein the peripheral walls of the cover include walls which are perpendicular to the one wall having the aperture, and the perpendicular walls have inner surfaces from which locking projections project inwardly; opposable orifices for receiving the projections being formed in the tubular post on which the cover is placed.

14. The fence of claim 13, wherein the projections in the walls of the cover are of a curved shape and contour of a size equal to or less than the opening of the orifices into the walls of the post for the projections to be received within the orifices.

15. The fence of claim 14, wherein the projections have a ramp form which start out on the surface of the corresponding wall of the cover, extend toward the bottom of the cover, and progressively separate from the wall surface, are bounded by a transverse plane.

16. The fence of claim 1, wherein the one horizontal rod of the panel is the uppermost horizontal rod, the post has an upper end situated approximately at the height of the uppermost horizontal rod, and the cover is coupled to the uppermost horizontal rod.

17. The fence of claim 16, wherein the cover includes a lateral flange bent toward the cover and which is wrapped around the horizontal rod so that the cover may rotate around the rod.

18. A modular fence comprising a plurality of wire mesh panels and a plurality of support posts attached to the panels;

the posts being installable on a supporting base, the support posts having a width or diameter;

each of the plurality of panels comprising a plurality of vertical rods spaced apart from one another and a plurality of horizontal rods spaced apart from one another, the horizontal rods intersecting the vertical rods, at least two of the vertical rods on each of the panels being separated by a distance approximately equal to the diameter or width of a respective one of the support posts which is positioned between and extends between the at least two vertical rods of the panel;

the panel having a profile such that there is a non-depressed section of the panel and at least one horizontally extending inward depression of the panel; the at least two vertical rods and the support post between them extending in the vertical direction transverse to the horizontally extending depression of the panel and the vertical rods and the support post being of such length that the support post extends between the vertical rods and over a vertical distance to extend past the non-depressed section and the depression of the panel;

wherein there are a plurality of the horizontally extending shaped depressions of each of the panels;

at least two of the panels have lateral ends and a lateral end of each of the two panels is arranged adjacent the lateral end of the other adjacent panel, the lateral ends of the panels having an extreme vertical rod at the lateral end thereof adjacent to the lateral end of the other panel;

a respective one of the support posts between the at least two vertical rods at each lateral end of each of the at least two panels;

a respective cover at each of the support posts at the adjacent ends of two panels; each cover having a respective lateral arm, which extends toward the adjacent panel and which terminates in an extreme stretch, a through orifice through the stretch of each lateral arm; the extreme stretches of the covers at adjacent panel ends being superimposable with the respective orifices lined up; and a joining element that may act as an axis of articulation between the two caps joining the stretches at the adjacent panel ends at the respective orifices.

* * * * *